US008915451B2

(12) United States Patent
Takahashi et al.

(10) Patent No.: US 8,915,451 B2
(45) Date of Patent: Dec. 23, 2014

(54) HUMIDITY ADJUSTMENT DEVICE

(75) Inventors: Takashi Takahashi, Sakai (JP); Tooru Fujimoto, Sakai (JP); Gakuto Sakai, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 14/131,373

(22) PCT Filed: Jun. 11, 2012

(86) PCT No.: PCT/JP2012/064887

§ 371 (c)(1),
(2), (4) Date: Jan. 7, 2014

(87) PCT Pub. No.: WO2013/008570

PCT Pub. Date: Jan. 17, 2013

(65) Prior Publication Data

US 2014/0166765 A1 Jun. 19, 2014

(30) Foreign Application Priority Data

Jul. 11, 2011 (JP) ..... 2011-153139

(51) Int. Cl.

| | |
|---|---|
| ***G05D 22/02*** | (2006.01) |
| ***F24F 3/14*** | (2006.01) |
| *F24F 11/00* | (2006.01) |

(52) U.S. Cl.

CPC ..... *F24F 11/0008* (2013.01); *F24F 11/0012* (2013.01); *F24F 3/1405* (2013.01); *F24F 2011/0013* (2013.01); *F24F 3/14* (2013.01)

USPC ..... 236/44 A; 62/94; 62/141

(58) Field of Classification Search

USPC ..... 62/93, 94, 141, 271; 236/44 A

See application file for complete search history.

(56) References Cited

U.S. PATENT DOCUMENTS

| | | | | |
|---|---|---|---|---|
| 2007/0028639 | A1 | 2/2007 | Ikegami et al. | |
| 2009/0038326 | A1 | 2/2009 | Matsui | |
| 2009/0230203 | A1 * | 9/2009 | Matsui et al. | 236/44 A |

FOREIGN PATENT DOCUMENTS

| | | | |
|---|---|---|---|
| CN | 1795349 | A | 6/2006 |
| JP | 2000-154927 | A | 6/2000 |
| JP | 2000-193325 | A | 7/2000 |
| JP | 2005-283041 | A | 10/2005 |
| JP | 2006-329593 | A | 12/2006 |
| JP | 2009-109146 | A | 5/2009 |
| JP | 2009-109150 | A | 5/2009 |
| JP | 2010-145024 | A | 7/2010 |

* cited by examiner

*Primary Examiner* — Marc Norman

(74) *Attorney, Agent, or Firm* — Birch, Stewart, Kolasch & Birch, LLP

(57) ABSTRACT

When a humidity adjustment device starts up, an outside air temperature To and an room air temperature Tr are compared to determine which air temperature is higher. By mutually changing the flow of the outside air and the flow of the room air by means of an air circulation switching device, the air having the higher temperature of the outside air and the room air is circulated to a heat exchanger that operates as an evaporator.

9 Claims, 6 Drawing Sheets

Fig.2(A) First Action Mode
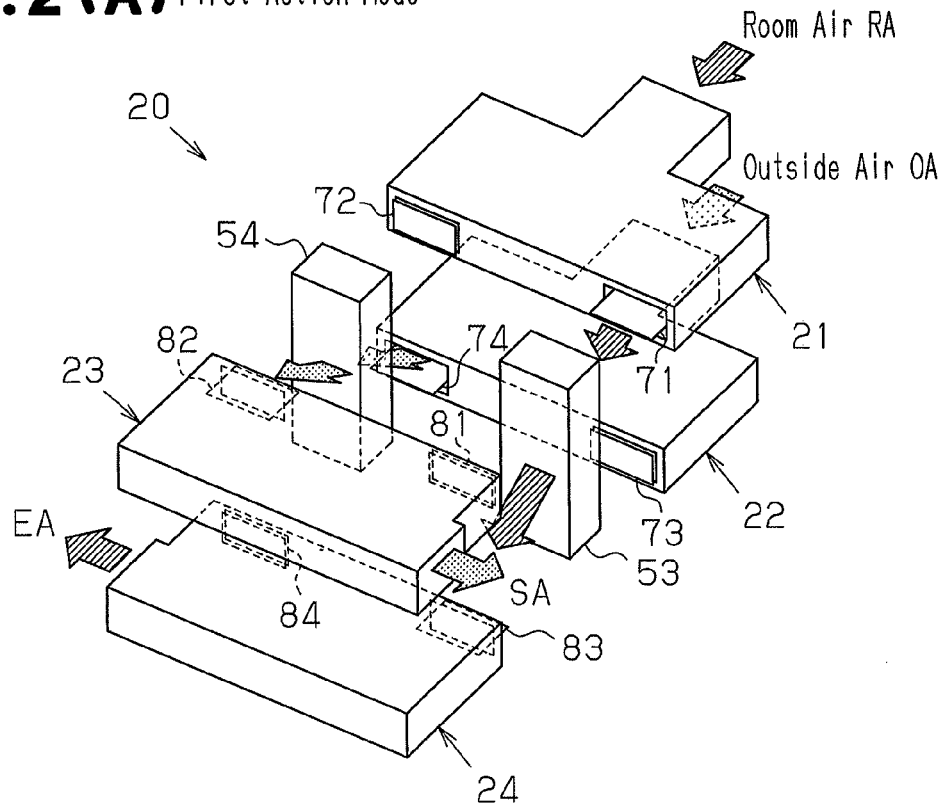
Fig.2(B) Second Action Mode
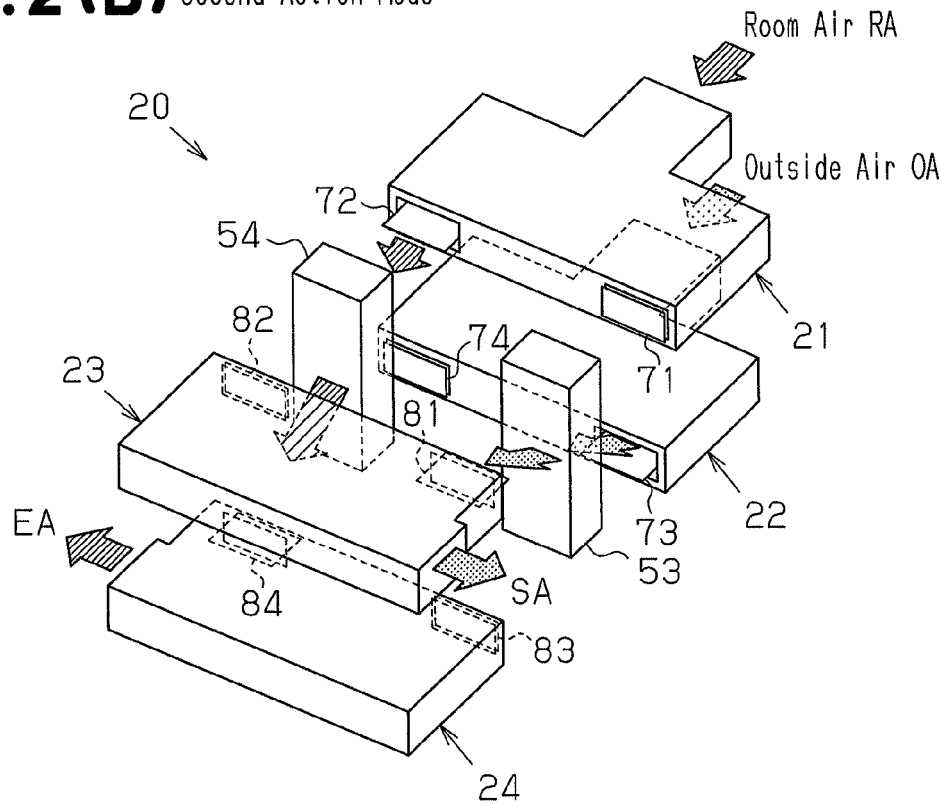

Fig.5

[Operation Mode]

| Operation Mode | Four-Way Switching Valve | Air Circulation Switching Device | Type of Air to Be Circulated Through Evaporator |
|---|---|---|---|
| Dehumidifying Operation | First Switching State | First Action Mode | Outside Air (OA) |
| | Second Switching State | Second Action Mode | Outside Air (OA) |
| Humidifying Operation | Second Switching State | First Action Mode | Room Air (RA) |
| | First Switching State | Second Action Mode | Room Air (RA) |

Fig.6

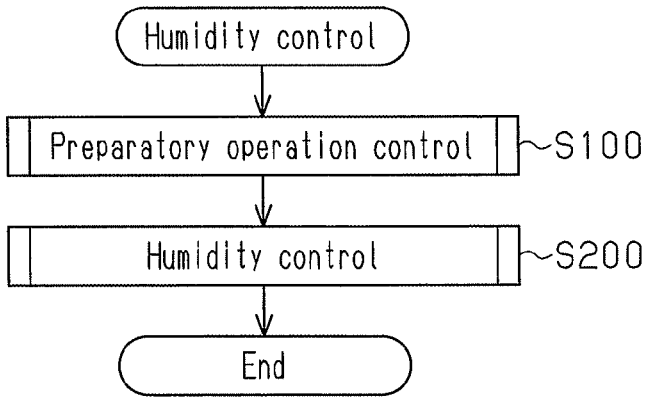

| | Four-Way Switching Valve | Outside Air Temperature To > Room Air Temperature Tr | Outside Air Temperature To & Room Air Temperature Tr | Air Circulation Switching Device |
|---|---|---|---|---|
| No1 | First Switching State | ○ | – | First Action Mode |
| No2 | First Switching State | – | ○ | Second Action Mode |
| No3 | Second Switching State | ○ | – | Second Action Mode |
| No4 | Second Switching State | – | ○ | First Action Mode |

HUMIDITY ADJUSTMENT DEVICE

TECHNICAL FIELD

The present invention relates to a humidity adjustment device which includes two heat exchangers each carrying an adsorbent.

BACKGROUND ART

A humidity adjustment device described in Patent Literature 1 includes two heat exchangers. Each of the heat exchangers has an adsorbent fixed to it, which, at temperatures equal to or lower than a predetermined temperature, performs an adsorption action of absorbing water, and once the predetermined temperature is exceeded, starts a regeneration action by releasing the water. In the humidity adjustment device, the outside air is forced into the inside of the room through one of the heat exchangers, while the room air is exhausted to the outside of the room through the other heat exchanger. Since the temperature is equal to or lower than the predetermined temperature when the heat exchanger acts as an evaporator, it performs the adsorption action and fulfills a dehumidification function. On the other hand, since the temperature is equal to or higher than the predetermined temperature when the heat exchanger acts as a condenser, it performs the regeneration action and fulfills a humidification function. Accordingly, when the room is to be humidified, the outside air is passed through the heat exchanger acting as the condenser before it is supplied to the inside of the room. When the room is to be dehumidified, the outside air is passed through the heat exchanger acting as the evaporator before it is supplied to the inside of the room.

At the time of startup of the humidity adjustment device, in order to measure the outside air temperature and the room air temperature, a fan is driven to force the outside air and the room air into the humidity adjustment device. At this point, if the temperature of the air passing through the evaporator is excessively low, an amount of a refrigerant resulting from liquefaction of the evaporated refrigerant in the evaporator becomes larger. If the compressor is started in this condition, an excessive amount of the liquid refrigerant is sucked into the compressor, making it difficult for an accumulator to completely separate the gas and the liquid. This can result in the liquid refrigerant returning to the compressor. It is therefore necessary to suppress the return of the liquid refrigerant which occurs at the time of startup of the humidity adjustment device.

PRIOR ART DOCUMENT

Patent Document

Patent Document 1: Japanese Laid-Open Patent Publication No. 2010-145024

SUMMARY OF THE INVENTION

Problems that the Invention is to Solve

The present invention aims to provide a humidity adjustment device capable of suppressing return of a liquid refrigerant which occurs at the time of startup of the humidity adjustment device.

Means for Solving the Problems

In order to achieve the above aim, according to a first aspect of the present invention, there is provided a humidity adjustment device (1), including: a refrigerant circuit (10) which includes a compressor (13), a first heat exchanger (11) carrying an adsorbent, a second heat exchanger (12) carrying an adsorbent, an electronic expansion valve (14), and a four-way switching valve (15); and an air circulation switching device (20) which switches air to be circulated through the first heat exchanger (11) and air to be circulated through the second heat exchanger (12), wherein one of the first heat exchanger (11) and the second heat exchanger (12) is defined as a condenser to function as a humidifier by a regeneration action of the adsorbent, while the other heat exchanger is defined as an evaporator to function as a dehumidifier by an adsorption action of the adsorbent, and the functions of both the heat exchangers are switched by changing a refrigerant flow inside the refrigerant circuit (10) by the four-way switching valve (15). In the humidity adjustment device (1), an outside air temperature and a room air temperature are compared to determine which of the air temperatures is higher, and at the time of startup of the humidity adjustment device (1), one of the outside air and the room air which is at a higher temperature is circulated through the heat exchanger acting as the evaporator, of the first heat exchanger (11) and the second heat exchanger (12), while the air at a lower temperature is circulated through the heat exchanger acting as the condenser, of the first heat exchanger (11) and the second heat exchanger (12).

According to this configuration, of the outside air and the room air forced into the humidity adjustment device (1), the air at a higher temperature is introduced into the evaporator, and thereby the excessive liquefaction of the refrigerant in the evaporator resulting from the excessive cooling of the evaporator can be suppressed. Accordingly, the return of the liquid refrigerant to the compressor (13) can be suppressed.

In the above humidity adjustment device, it is preferable that when the humidity adjustment device (1) is shut down, at least in a humidification operation period and in a dehumidification operation period, a refrigerant passage where the electronic expansion valve (14) is provided be put into a communicating state.

Here, the refrigerant passage where the electronic expansion valve (14) is provided is the refrigerant passage, of the refrigerant passages connecting the first heat exchanger (11) and the second heat exchanger (12), where the electronic expansion valve (14) is mounted. Upon shutdown of the humidity adjustment device (1), the high-pressure side refrigerant flows toward the low-pressure side due to the pressure equalization effect in the refrigerant circuit. For this reason, during the shutdown period of the humidity adjustment device (1), if the opening degree of the electronic expansion valve (14) is set to a blocking opening degree and the refrigerant passage is blocked, the amount of the refrigerant flowing through the electronic expansion valve becomes smaller, while the amount of the refrigerant moving through the compressor becomes larger. This leads to a problem that, as the lubricating oil in the compressor moves along with the refrigerant to the evaporator, the amount of the lubricating oil in the compressor decreases.

In this respect, in the present invention, when the humidity adjustment device (1) is shut down, at least in the humidification operation period and in the dehumidification operation period, the refrigerant passage where the electronic expansion valve (14) is provided is put into a communicating state. Thus, during shutdown of the humidity adjustment device (1), the refrigerant inside the passage where the electronic expansion valve (14) is provided can be moved. This allows a smaller amount of the refrigerant to be sucked into the compressor (13).

In the above humidity adjustment device, it is preferable that the humidity adjustment device (1) be provided inside with: a first temperature sensor (31) which detects the room air temperature; a second temperature sensor (32) which detects the outside air temperature; an exhaust fan (92) which forces the room air into the humidity adjustment device (1) and exhausts the room air to the outside of the room; and a supply fan (91) which forces the outside air into the humidity adjustment device (1) and supplies the outside air to the inside of the room, wherein, at the time of startup of the humidity adjustment device (1) and before the start of the compressor (13), the exhaust fan (92) is driven to force the room air in, while the supply fan (91) is driven to force the outside air in, and on the basis of a difference occurring between the temperature detected by the first temperature sensor (31) and the temperature detected by the second temperature sensor (32), the outside air temperature and the room air temperature are compared to determine which of the air temperatures is higher.

When the outside air temperature and the room air temperature are measured, the outside air and the room air are introduced into the humidity adjustment device (1). In this case, either the outside air or the room air is introduced into the evaporator without a determination being made as to which of the outside air and the room air is at a higher temperature. On the other hand, precise measurement of the outside air temperature and the room air temperature requires a considerable amount of time. Once the low-temperature air circulates through the evaporator, the evaporator can be excessively cooled during measurement of the temperatures of the outside air and the room air.

In contrast to this, in the present invention, the air at a higher temperature is determined on the basis of the difference between the temperature detected by the first temperature sensor (31) and the temperature detected by the second temperature sensor (32). That is, before the temperatures of the outside air and the room air are precisely measured, which of the air temperatures is higher is determined. This allows a reduction in the time taken to determine which of the air temperatures of the outside air and the room air is higher. Accordingly, the excessive cooling of the evaporator can be suppressed.

In the above humidity adjustment device, it is preferable that at the time of startup of the humidity adjustment device (1), if the outside air temperature and the room air temperature are both higher than a set temperature, the process, in which one of the outside air and the room air which is at a higher temperature is circulated through the heat exchanger functioning as the evaporator, be not executed.

The conditions for the evaporated refrigerant present in the evaporator to be liquefied in a large amount are rarely met. This phenomenon occurs only when the temperature of the air flowing into the evaporator is equal to or lower than the predetermined temperature. In other words, when this condition is not established, as the amount of liquefaction of the evaporated refrigerant is small, the liquid refrigerant is unlikely to flow into the compressor (13) through the accumulator. In this respect, in the present invention, at the time of startup of the humidity adjustment device (1), if the outside air temperature and the room air temperature are both equal to or higher than the set temperature, the process, in which one of the outside air and the room air which is t at a higher temperature is circulated through the evaporator, is not executed. This way of processing allows the air to be introduced into the heat exchanger in the same pattern as in the main operation.

In order to achieve the above aim, according to a second aspect of the present invention, there is provided a humidity adjustment device (1), including: a refrigerant circuit (10) which includes a compressor (13), a first heat exchanger (11) carrying an adsorbent, a second heat exchanger (12) carrying an adsorbent, an electronic expansion valve (14), and a four-way switching valve (15); and an air circulation switching device (20) which switches air to be circulated through the first heat exchanger (11) and air to be circulated through the second heat exchanger (12), wherein one of the first heat exchanger (11) and the second heat exchanger (12) is defined as a condenser to function as a humidifier by a regeneration action of the adsorbent, while the other heat exchanger is defined as an evaporator to function as a dehumidifier by an adsorption action of the adsorbent, and the functions of both the heat exchangers are switched by changing a refrigerant flow inside the refrigerant circuit (10) by the four-way switching valve (15). At the time of startup of the humidity adjustment device (1), the outside air is forced into one of the evaporator and the condenser, while the room air is forced into the other, and the outside air temperature and the room air temperature are compared to determine which of the air temperatures is higher, and at the time of start of the compressor (13), the four-way switching valve (15) is switched such that, of the first heat exchanger (11) and the second heat exchanger (12), the heat exchanger through which the air at a higher temperature is circulating functions as the evaporator.

In this invention, the outside air is forced into one of the evaporator and the condenser, while the room air is forced into the other, to determine which of the outside air and the room air is at a higher temperature. Then, the action of the four-way switching valve (15) causes the heat exchanger, through which the air at a higher temperature is circulating, to function as the evaporator. This configuration allows the liquid refrigerant to be present in the condenser, even when either the outside air or the room air is at a temperature low enough to cause the excessive liquefaction of the refrigerant. Thus, the inflow of the liquid refrigerant into the compressor (13) at the time of startup of the compressor (13) can be suppressed.

In order to achieve the above aim, according to a third aspect of the present invention, there is provided a humidity adjustment device (1), including: a refrigerant circuit (10) which includes a compressor (13), a first heat exchanger (11) carrying an adsorbent, a second heat exchanger (12) carrying an adsorbent, an electronic expansion valve (14), and a four-way switching valve (15); and an air circulation switching device (20) which switches air to be circulated through the first heat exchanger (11) and air to be circulated through the second heat exchanger (12), wherein one of the first heat exchanger (11) and the second heat exchanger (12) is defined as a condenser to function as a humidifier by a regeneration action of the adsorbent, while the other heat exchanger is defined as an evaporator to function as a dehumidifier by an adsorption action of the adsorbent, and the functions of both the heat exchangers are switched by changing a refrigerant flow inside the refrigerant circuit (10) by the four-way switching valve (15). At the time of startup of the humidity adjustment device (1), the outside air and the room air are forced into the humidity adjustment device (1) through a passage other than the first heat exchanger (11) and the second heat exchanger (12).

In this invention, since the air led to the humidity adjustment device (1) is not introduced into the heat exchanger, the evaporator is not cooled by the outside air or the room air. Thus, by this configuration, the inflow of a large amount of the liquid refrigerant into the compressor at the time of startup of the compressor can be suppressed.

Effects of the Invention

According to the present invention, it is possible to provide a humidity adjustment device capable of suppressing return of a liquid refrigerant which occurs at the time of startup of the humidity adjustment device.

BRIEF DESCRIPTION OF THE DRAWINGS

FIG. 2(*a*) is a perspective view showing a first action mode of an air circulation switching device;

FIG. 2(*b*) is a perspective view showing a second action mode of the air circulation switching device;

FIG. 5 is a table showing a relation among an operation mode of the humidity adjustment device, a switching state of a four-way switching valve, and the action mode of the air circulation switching device;

FIG. 6 is a flow chart showing a procedure of humidity control;

FIG. 9(*b*) is a diagram showing a state of the refrigerant circuit and an air flow when the outside air temperature is equal to or lower than the room air temperature.

MODES FOR CARRYING OUT THE INVENTION

Hereinafter, a humidity adjustment device according to one embodiment of the present invention will be described with reference to the drawings.

Figure 1:
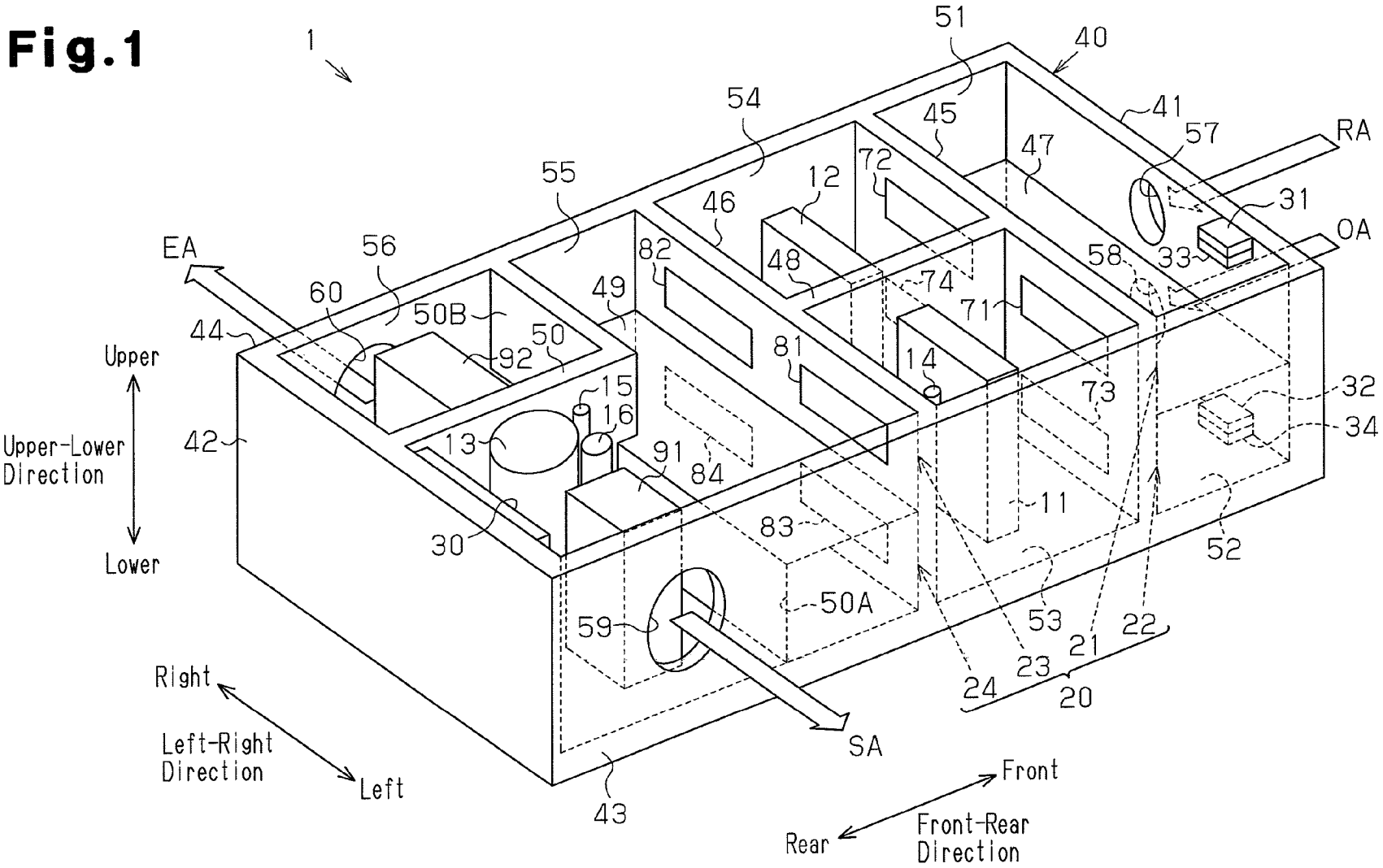
FIG. 1 is a perspective view of a humidity adjustment device according to one embodiment of the present invention.
Figure 3:
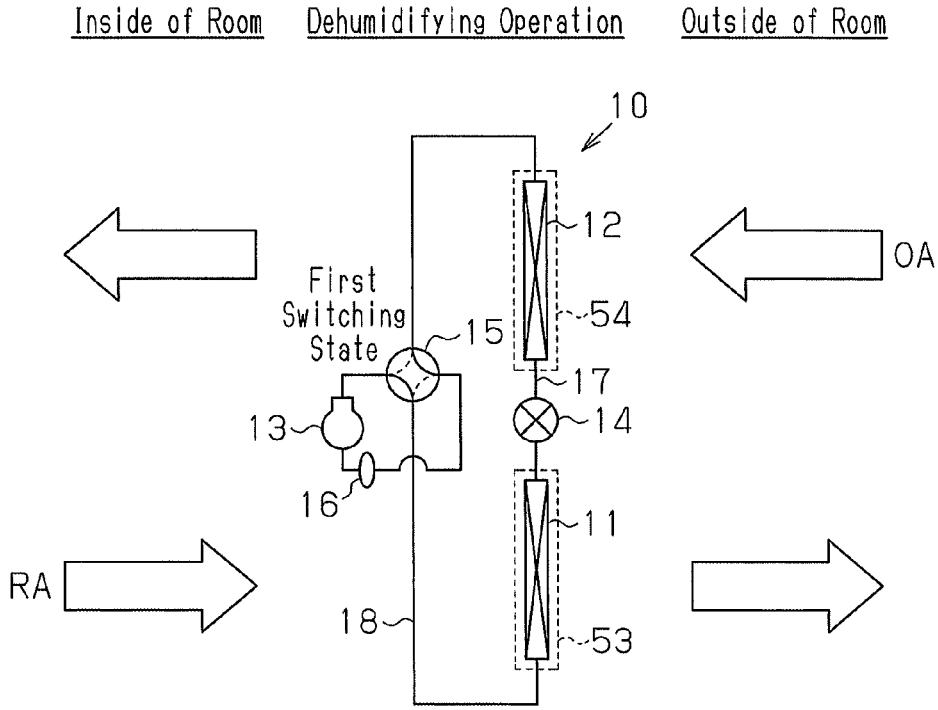
FIG. 3 is a diagram for explaining a dehumidifying operation of the humidity adjustment device.

As shown in FIG. 1 and FIG. 3, a humidity adjustment device 1 includes a refrigerant circuit 10, an air circulation switching device 20, and a control device 30. The air circulation switching device 20 controls a flow of air to be circulated through the humidity adjustment device 1, and the control device 30 controls the refrigerant circuit 10 and the air circulation switching device 20. The humidity adjustment device 1 controls humidity of outside air OA taken in from the outside of the room, and thereafter supplies the outside air to the inside of the room. Further, the humidity adjustment device 1 controls humidity of room air RA taken in from the inside of the room, and thereafter exhausts the room air to the outside of the room.

The refrigerant circuit 10 includes a compressor 13, a first heat exchanger 11 carrying an adsorbent, a second heat exchanger 12 carrying an adsorbent, an electronic expansion valve 14, and a four-way switching valve 15. The adsorbent absorbs water. Namely, the each of the first heat exchanger 11 and the second heat exchanger 12 functions as a dehumidifier when it acts as an evaporator, and functions as a humidifier when it acts as a condenser.

The electronic expansion valve 14 is provided in a first refrigerant passage 17 which connects the first heat exchanger 11 and the second heat exchanger 12. The compressor 13 is provided in a second refrigerant passage 18 which connects the first heat exchanger 11 and the second heat exchanger 12. The four-way switching valve 15 is provided in the middle of the second refrigerant passage 18 and reverses a flow direction of the refrigerant. An accumulator 16 is provided near a refrigerant suction port of the compressor 13.

The four-way switching valve 15 is switched between a first switching state and a second switching state. In the first switching state, a discharge port of the compressor 13 is connected to the first heat exchanger 11, while the suction port of the compressor 13 is connected to the second heat exchanger 12. That is, in the first switching state, the first heat exchanger 11 acts as the condenser, while the second heat exchanger 12 acts as the evaporator. In the second switching state, the discharge port of the compressor 13 is connected to the second heat exchanger 12, while the suction port of the compressor 13 is connected to the first heat exchanger 11. That is, in the second switching state, the first heat exchanger 11 acts as the evaporator, while the second heat exchanger 12 acts as the condenser.

The heat exchanger as the evaporator cools the air, and at the same time, absorbs water by an adsorption action of the adsorbent. Thus, the air is dehumidified. Namely, the heat exchanger acting as the evaporator functions as the dehumidifier. The heat exchanger as the condenser heats the adsorbent and thereby evaporates the water from the adsorbent by a regeneration action of the adsorbent. Thus, the air is humidified. Namely, the heat exchanger acting as the condenser functions as the humidifier.

The four-way switching valve 15 periodically switches between the first switching state and the second switching state. Accordingly, each time the four-way switching valve 15 switches, the functions of the first heat exchanger 11 and the second heat exchanger 12 are also switched. Specifically, after a lapse of a predetermined time since the first heat exchanger 11 has started acting as the evaporator and the second heat exchanger 12 has started acting as the condenser, the first heat exchanger 11 starts acting as the condenser and the second heat exchanger 12 starts acting as the evaporator. That is, by the first heat exchanger 11 and the second heat exchanger 12 alternately acting as the evaporator and the condenser, adsorption and exhaust of the water are repeated. In this way, one of the heat exchangers acts as the humidifier performing the regeneration action, while the other heat exchanger acts as the dehumidifier performing the adsorption action.

The control device 30 controls the switching of the four-way switching valve 15, the adjustment of the opening degree of the electronic expansion valve 14, the frequency of the power to be supplied to the compressor 13, and the action of the air circulation switching device 20, on the basis of a detection value of each sensor and a command by a remote controller. The control device 30 is connected with a first temperature sensor 31 which measures the temperature of the room air RA (room air temperature Tr), a second temperature sensor 32 which measures the temperature of the outside air OA (outside air temperature To), a first humidity sensor 33 which measures the humidity of the room air RA, and a second humidity sensor 34 which measures the humidity of the outside air OA.

The air circulation switching device 20 is constituted of four devices. A first device circulates the room air RA through one of the first heat exchanger 11 and the second heat exchanger 12. Whether the room air RA is to be circulated through the first heat exchanger 11 or the second heat exchanger 12 is determined on the basis of the detection value of the temperature sensor and the operational state of the humidity adjustment device 1. The first device will be referred to as a room air switching device 21. A second device circulates the outside air OA through the heat exchanger, through which the room air RA is not circulating, of the first heat exchanger 11 and the second heat exchanger 12. The second device will be referred to as an outside air switching device 22. A third device selects one of the air discharged from the first heat exchanger 11 and the air discharged from the second heat exchanger 12, and supplies the selected air as supply air SA to the inside of the room. The third device will be referred to as a supply air switching device 23. A fourth device selects one of the air discharged from the first heat exchanger 11 and the air discharged from the second heat exchanger 12, and exhausts the selected air as exhaust air EA to the outside of the room. The fourth device will be referred to as an exhaust air switching device 24.

The refrigerant circuit 10, the air circulation switching device 20, and the control device 30 are housed in one casing 40. In the following, the positional relation of these components will be described with the front-rear direction, the left-right direction, and the upper-lower direction defined as shown in FIG. 1.

The casing 40 is formed into a rectangular parallelepiped. The inside of the casing 40 is divided into six compartments. A front wall 41 is provided at a front end of the casing 40. A first partitioning wall 45, which is parallel to the front wall 41, and a second partitioning wall 46, which is located at the rear of the first partitioning wall 45, are provided inside the casing 40. Further, a third partitioning wall 47 which partitions a space between the front wall 41 and the first partitioning wall 45 is provided inside the casing 40. A space between the front wall 41 and the first partitioning wall 45 is partitioned into a first front compartment 51 and a second front compartment 52 located under the first front compartment 51.

A fourth partitioning wall 48 which partitions a space between the first partitioning wall 45 and the second partitioning wall 46 is provided inside the casing 40. Of the two compartments partitioned by the fourth partitioning wall 48, a left-side compartment houses the first heat exchanger 11, and a right-side compartment houses the second heat exchanger 12. The compartment housing the first heat exchanger 11 will be referred to as a first heat exchanger compartment 53, and the compartment housing the second heat exchanger 12 will be referred to as a second heat exchanger compartment 54. The electronic expansion valve 14 is installed in the first heat exchanger compartment 53.

A rear wall 42 is provided at a rear end of the casing 40. A space between the rear wall 42 and the second partitioning wall 46 is divided into a first rear compartment 55 and a second rear compartment 56 by a fifth partitioning wall 49 to an eighth partitioning wall 50B. The fifth partitioning wall 49 divides a front half (front space) of the space between the rear wall 42 and the second partitioning wall 46 into upper and lower halves. A sixth partitioning wall 50 divides a rear half (rear space) of the space between the rear wall 42 and the second partitioning wall 46 into left and right halves. A seventh partitioning wall 50A partitions the lower half space of the front space and the left half space of the rear space. The eighth partitioning wall 50B partitions the upper half space of the front space and the right half space of the rear space. The first rear compartment 55 is constituted of the upper half of the front space and the left half of the rear space. The second rear compartment 56 is constituted of the lower half of the front space and the right half of the rear space. The front wall 41 is provided with a room suction port 57 for suctioning the room air RA. The first partitioning wall 45 has a first front opening-closing mechanism 71 and a second front opening-closing mechanism 72.

The first front opening-closing mechanism 71 is formed of an opening part which is provided in the first partitioning wall 45 and is opened to the first heat exchanger compartment 53, and a damper which opens and closes the opening part. The first front opening-closing mechanism 71 is switched by the damper between a state where the opening part is opened (opened state) and a state where the opening part is closed (closed state). When the first front opening-closing mechanism 71 is in the opened state, the first front compartment 51 and the first heat exchanger compartment 53 are allowed to communicate with each other. When the first front opening-closing mechanism 71 is in the closed state, air circulation between the first front compartment 51 and the first heat exchanger compartment 53 is blocked.

The second front opening-closing mechanism 72 is formed of an opening part which is provided in the first partitioning wall 45 and is opened to the second heat exchanger compartment 54, and a damper which opens and closes the opening part. The second front opening-closing mechanism 72 is also switched by the damper between the opened state and the closed state. When the second front opening-closing mechanism 72 is in the opened state, the first front compartment 51 and the second heat exchanger compartment 54 are allowed to communicate with each other. When the second front opening-closing mechanism 72 is in the closed state, air circulation between the first front compartment 51 and the second heat exchanger compartment 54 is blocked. Thus, the room air switching device 21 is constituted of the first front compartment 51, the room suction port 57, the first front opening-closing mechanism 71, and the second front opening-closing mechanism 72. The first temperature sensor 31 and the first humidity sensor 33 are installed in the first front compartment 51.

The front wall 41 is provided with an outside suction port 58 for suctioning the outside air OA. The first partitioning wall 45 facing the second front compartment 52 has a third front opening-closing mechanism 73 and a fourth front opening-closing mechanism 74.

The third front opening-closing mechanism 73 is formed of an opening part which is provided in the first partitioning wall 45 and is opened to the first heat exchanger compartment 53, and a damper which opens and closes the opening part. The third front opening-closing mechanism 73 is switched by the damper between the opened state and the closed state. When the third front opening-closing mechanism 73 is in the opened state, the second front compartment 52 and the first heat exchanger compartment 53 are allowed to communicate with each other. When the third front opening-closing mechanism 73 is in the closed state, air circulation between the second front compartment 52 and the first heat exchanger compartment 53 is blocked.

The fourth front opening-closing mechanism 74 is formed of an opening part which is provided in the first partitioning wall 45 and is opened to the second heat exchanger compartment 54, and a damper which opens and closes the opening part. The fourth front opening-closing mechanism 74 is switched between the opened state and the closed state. When the fourth front opening-closing mechanism 74 is in the opened state, the second front compartment 52 and the second heat exchanger compartment 54 are allowed to communicate with each other. When the fourth front opening-closing mechanism 74 is in the closed state, air circulation between the second front compartment 52 and the second heat exchanger compartment 54 is blocked. Thus, the outside air switching device 22 is constituted of the second front compartment 52, the outside suction port 58, the third front opening-closing mechanism 73, and the fourth front opening-closing mechanism 74. The second temperature sensor 32 and the second humidity sensor 34 are installed in the second front compartment 52.

A left-side wall 43 of the first rear compartment 55 is provided with a supply port 59 for supplying the air to the inside of the room. The second partitioning wall 46 facing the first rear compartment 55 has a first rear opening-closing mechanism 81 and a second rear opening-closing mechanism 82.

The first rear opening-closing mechanism 81 is formed of an opening part which is provided in the second partitioning wall 46 and is opened to the first heat exchanger compartment 53, and a damper which opens and closes the opening part. The first rear opening-closing mechanism 81 is switched by the damper between the opened state and the closed state. When the first rear opening-closing mechanism 81 is in the opened state, the first rear compartment 55 and the first heat exchanger compartment 53 are allowed to communicate with each other. When the first rear opening-closing mechanism 81 is in the closed state, air circulation between the first rear compartment 55 and the first heat exchanger compartment 53 is blocked.

The second rear opening-closing mechanism 82 is formed of an opening part which is provided in the second partitioning wall 46 and is opened to the second heat exchanger compartment 54, and a damper which opens and closes the opening part. The second rear opening-closing mechanism 82 is switched by the damper between the opened state and the closed state. When the second rear opening-closing mechanism 82 is in the opened state, the first rear compartment 55 and the second heat exchanger compartment 54 are allowed to communicate with each other. When the second rear opening-closing mechanism 82 is in the closed state, air circulation between the first rear compartment 55 and the second heat exchanger compartment 54 is blocked. Thus, the supply air switching device 23 is constituted of the first rear compartment 55, the supply port 59, the first rear opening-closing mechanism 81, and the second rear opening-closing mechanism 82.

The compressor 13, the four-way switching valve 15, and the accumulator 16 are installed in the first rear compartment 55. The first rear compartment 55 is also provided with a supply fan 91 for suctioning the outside air OA into the humidity adjustment device 1 and releasing the outside air to the inside of the room. The supply fan 91 is, for example, a sirocco fan.

A right-side wall 44 is provided with an exhaust port 60 for exhausting the air to the outside of the room. The second partitioning wall 46 facing the second rear compartment 56 has a third rear opening-closing mechanism 83 and a fourth rear opening-closing mechanism 84.

The third rear opening-closing mechanism 83 is formed of an opening part which is provided in the second partitioning wall 46 and is opened to the first heat exchanger compartment 53, and a damper which opens and closes the opening part. The third rear opening-closing mechanism 83 is switched by the damper between the opened state and the closed state. When the third rear opening-closing mechanism 83 is in the opened state, the second rear compartment 56 and the first heat exchanger compartment 53 are allowed to communicate with each other. When the third rear opening-closing mechanism 83 is in the closed state, air circulation between the second rear compartment 56 and the first heat exchanger compartment 53 is blocked.

The fourth rear opening-closing mechanism 84 is formed of an opening part which is provided in the second partitioning wall 46 and is opened to the second heat exchanger compartment 54, and a damper which opens and closes the opening part. The fourth rear opening-closing mechanism 84 is switched by the damper between the opened state and the closed state. When the fourth rear opening-closing mechanism 84 is in the opened state, the second rear compartment 56 and the second heat exchanger compartment 54 are allowed to communicate with each other. When the fourth rear opening-closing mechanism 84 is in the closed state, air circulation between the second rear compartment 56 and the second heat exchanger compartment 54 is blocked.

Thus, the exhaust air switching device 24 is constituted of the second rear compartment 56, the exhaust port 60, the third rear opening-closing mechanism 83, and the fourth rear opening-closing mechanism 84. The second rear compartment 56 is provided with an exhaust fan 92 for suctioning the room air RA into the humidity adjustment device 1 and releasing the room air to the outside of the room. The exhaust fan 92 is, for example, a sirocco fan.

Next, action modes of the air circulation switching device 20 will be described with reference to FIG. 2(*a*) and FIG. 2(*b*).

The air circulation switching device 20 changes the flow of the room air RA as well as changes the flow of the outside air OA. The air circulation switching device 20 has a first action mode and a second action mode. By switching between the first and second action modes, the flow of the room air RA and the flow of the outside air OA are switched.

In the first action mode, the room air RA circulates through the first heat exchanger compartment 53, while the outside air OA circulates through the second heat exchanger compartment 54. Specifically, as shown in FIG. 2(*a*), the first front opening-closing mechanism 71 is put into the opened state while the second front opening-closing mechanism 72 is put into the closed state, and the third rear opening-closing mechanism 83 is put into the opened state while the fourth rear opening-closing mechanism 84 is put into the closed state. This causes the room air RA to circulate through the first heat exchanger compartment 53. Further, the third front opening-closing mechanism 73 is put into the closed state while the fourth front opening-closing mechanism 74 is put into the opened state, and the first rear opening-closing mechanism 81 is put into the closed state while the second rear opening-closing mechanism 82 is put into the opened state. This causes the outside air OA to circulate through the second heat exchanger compartment 54.

In the second action mode, the room air RA circulates through the second heat exchanger compartment 54, and the outside air OA circulates through the first heat exchanger compartment 53. Specifically, as shown in FIG. 2(*b*), the first front opening-closing mechanism 71 is put into the closed state while the second front opening-closing mechanism 72 is put into the opened state, and the third rear opening-closing mechanism 83 is put into the closed state while the fourth rear opening-closing mechanism 84 is put into the opened state. This causes the room air RA to circulate through the second heat exchanger compartment 54. Further, the third front opening-closing mechanism 73 is put into the opened state while the fourth front opening-closing mechanism 74 is put into the closed state, and the first rear opening-closing mechanism 81 is put into the opened state while the second rear opening-closing mechanism 82 is put into the closed state. This causes the outside air OA to circulate through the first heat exchanger compartment 53.

Next, operation modes of the humidity adjustment device 1 will be described.

The humidity adjustment device 1 performs a dehumidifying operation, a humidifying operation, and a ventilating operation.

In the dehumidifying operation, the adsorption action of the adsorbent is performed by the heat exchanger acting as the evaporator. Thus, water is absorbed by the adsorbent to dehumidify the outside air OA, and the dehumidified outside air OA is supplied to the inside of the room. On the other hand, the regeneration action of the adsorbent containing the water is performed by the heat exchanger acting as the condenser. Thus, the water contained in the adsorbent is imparted to the room air RA, and the room air RA imparted with the water is exhausted to the outside of the room. In this way, the adsorbent is regenerated as an absorbent for absorbing water. The dehumidifying operation is mainly performed during the summer season.

In the humidifying operation, the regeneration action of the adsorbent containing the water is performed by the heat exchanger acting as the condenser. Thus, the water contained in the adsorbent is imparted to the outside air OA, and the humidified outside air OA is supplied to the inside of the room. On the other hand, the adsorption action of the adsorbent is performed by the heat exchanger acting as the evaporator. Thus, water is absorbed from the room air RA by absorbing the water by the adsorbent, and the room air RA is exhausted to the outside of the room. The water absorbed from the room air RA is used as the water for humidifying the outside air OA. The humidifying operation is mainly executed during the winter season.

The ventilating operation refers to an operation in which the refrigerant circuit 10 is stopped to supply the outside air OA to the inside of the room and exhaust the room air RA to the outside of the room. The ventilating operation is mainly executed during the spring season and the fall season. For example, the ventilating operation is executed when the temperature of the outside air OA is equal to or higher than a first set temperature TA and equal to or lower than a second set temperature TB.

Next, the action of the refrigerant circuit 10 during the dehumidifying operation will be described with reference to FIG. 3.

In the dehumidifying operation, the outside air OA is forced into the heat exchanger acting as the evaporator, while the room air RA is forced into the heat exchanger acting as the condenser. Specifically, as shown in FIG. 3, when the four-way switching valve 15 is in the first switching state, the first heat exchanger 11 is defined as the condenser while the second heat exchanger 12 is defined as the condenser, and the air circulation switching device 20 is set to the first action mode. On the other hand, when the four-way switching valve 15 is in the second switching state, the first heat exchanger 11 is defined as the evaporator while the second heat exchanger 12 is defined as the condenser, and the air circulation switching device 20 is set to the second action mode. Thus, by switching the action mode of the air circulation switching device 20 in accordance with the switching action of the four-way switching valve 15, the outside air OA is forced into the heat exchanger acting as the evaporator.

Figure 4:
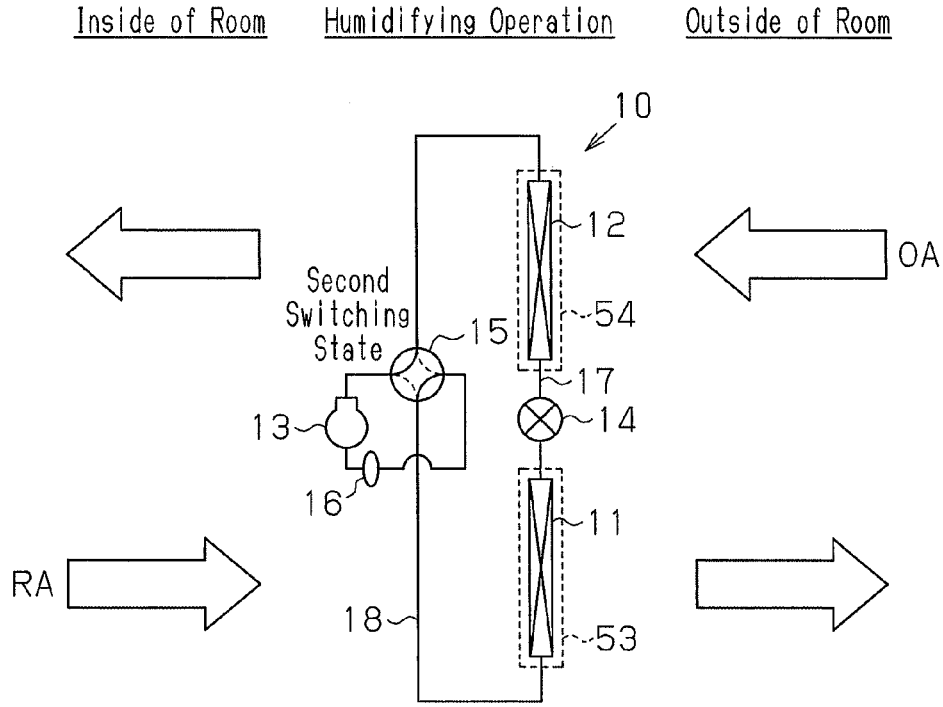
FIG. 4 is a diagram for explaining a humidifying operation of the humidity adjustment device.

Next, the action of the refrigerant circuit 10 during the humidifying operation will be described with reference to FIG. 4.

In the humidifying operation, the room air RA is forced into the heat exchanger acting as the evaporator, while the outside air OA is forced into the heat exchanger acting as the condenser. Specifically, as shown in FIG. 4, when the four-way switching valve 15 is in the second switching state, the first heat exchanger 11 is defined as the evaporator while the second heat exchanger 12 is defined as the condenser, and the air circulation switching device 20 is set to the first action mode. On the other hand, when the four-way switching valve 15 is in the first switching state, the first heat exchanger 11 is defined as the condenser while the second heat exchanger 12 is defined as the evaporator, and the air circulation switching device 20 is set to the second action mode. Thus, by switching the action mode of the air circulation switching device 20 in accordance with the switching action of the four-way switching valve 15, the outside air OA is forced into the heat exchanger acting as the condenser.

Next, the relation among each operation mode of the humidity adjustment device 1, the switching state of the four-way switching valve 15, and the air circulation switching device 20 will be described with reference to FIG. 5.

FIG. 5 shows the type of air to be circulated through the heat exchanger acting as the evaporator in each operation mode. In other words, FIG. 5 shows the type of air to be circulated through the heat exchanger acting as the evaporator when the switching state of the four-way switching valve 15 is set and the action mode of the air circulation switching device 20 is set.

Next, the procedure of humidity control will be described with reference to FIG. 6.

As shown in FIG. 6, when the humidity adjustment device 1 is in a shutdown state, a humidity control process is executed on the basis of a startup command. The startup command is formed by an ON signal, which is output by turning-on of a power switch provided on the remote controller, being received by the control device 30.

First, in step 100, the control device 30 executes preparatory operation control. The preparatory operation control is executed prior to the humidity control of adjusting the room humidity. The control device 30 determines whether the room humidity is to be increased or lowered. Next, in step S200, the control device 30 executes the humidity control. In the humidity control, the humidity of the outside air OA is controlled on the basis of the temperature of the outside air OA.

As shown in FIG. 5, when the operation mode is the dehumidifying operation, a combination of the first switching state of the four-way switching valve 15 and the first action mode of the air circulation switching device 20, and a combination of the second switching state of the four-way switching valve 15 and the second action mode of the air circulation switching device 20 are repeated. When the operation mode is the humidifying operation, a combination of the first switching state of the four-way switching valve 15 and the second action mode of the air circulation switching device 20, and a combination of the second switching state of the four-way switching valve 15 and the first action mode of the air circulation switching device 20 are repeated. When the operation mode is the ventilating operation, the compressor 13 stops. The air circulation switching device 20 is set to the first action mode or the second action mode. Then, the supply fan 91 and the exhaust fan 92 are driven. Thus, the outside air OA is taken into the inside of the room without being dehumidified or humidified, and the room air RA is exhausted to outside of the room without being dehumidified or humidified.

The humidity control stops on the basis of a shutdown command. For example, the shutdown command is formed by an OFF signal, which is output by turning-off of the power switch on the remote controller, being received by the control device 30. By the shutdown command, compressor stop control for stopping the compressor 13 is executed. Specifically, a frequency of a PWM signal of an inverter circuit becomes gradually smaller, and an electric motor of the compressor 13 eventually stops.

In addition, the opening degree of the electronic expansion valve 14 during the shutdown period is set by the shutdown command in accordance with the operation mode. Specifically, in a period when the ventilating operation is executed, the opening degree of the electronic expansion valve 14 is set to the blocking opening degree. In a period when the dehumidifying operation and a period when the humidifying operation are executed, the opening degree of the electronic expansion valve 14 is set to a stopping opening degree which is larger than the blocking opening degree. The blocking opening degree represents an opening degree at which the refrigerant becomes unable to move through the electronic expansion valve 14. If the opening degree of the electronic expansion valve 14 is set to the stopping opening degree during the shutdown period of the humidity adjustment device 1, the first refrigerant passage 17 where the electronic expansion valve 14 is provided is allowed to communicate, so that the refrigerant can move between the first heat exchanger 11 and the second heat exchanger 12.

Now, in the period when the dehumidifying operation is executed and the period when the humidifying operation is executed, the following phenomenon occurs if the opening degree of the electronic expansion valve 14 is set to the blocking opening degree and the first refrigerant passage 17 is closed during the shutdown period of the humidity adjustment device 1.

That is, due to a temperature difference between the first heat exchanger 11 and the second heat exchanger 12 during shutdown, the refrigerant moves between the both heat exchangers 11 and 12 trying to establish a thermally equilibrium state. In this case, if the first refrigerant passage 17 is closed, the refrigerant moves through the second refrigerant passage 18 where the compressor 13 is provided. This causes an increase in the amount of the refrigerant mixing into the lubricating oil in the compressor 13, and due to subsequent evaporation of the refrigerant, the lubricating oil flows out to the refrigerant circuit 10. As a result, the amount of the lubricating oil in the compressor 13 decreases.

In order to prevent such a phenomenon, at least in the period when the dehumidifying operation is executed or the period when the humidifying operation is executed, the first refrigerant passage 17 is maintained in a communicating state during the shutdown period by setting the opening degree of the electronic expansion valve 14 to be larger than the blocking opening degree.

Next, the procedure of the preparatory operation control will be described with reference to FIG. 7 and FIG. 8.

In step S210, the control device 30 detects the switching state of the four-way switching valve 15. The control device 30 thereby determines, at the time of start of the compressor 13, whether the first heat exchanger 11 is either the evaporator or the condenser, and whether the second heat exchanger 12 is either the evaporator or the condenser.

In step S220, the control device 30 drives the exhaust fan 92 and the supply fan 91. This causes the outside air OA and the room air RA to circulate through the inside of the humidity adjustment device 1. At this point, the opening degree of the electronic expansion valve 14 is maintained to the opening degree for the shutdown period of the humidity adjustment device 1. In addition, the compressor 13 is maintained in a shutdown state.

In step S230, after a lapse of a predetermined time since the start of the exhaust fan 92 and the supply fan 91, the room air temperature Tr is measured by the first temperature sensor 31, and the outside air temperature To is measured by the second temperature sensor 32. Then, the control device 30 compares the room air temperature Tr and the outside air temperature To to determine which of the room air temperature Tr and the outside air temperature To is higher. In order to reduce the determination time, the control device 30 compares the room air temperature Tr and the outside air temperature To when a difference occurs between the both temperatures, and determines which of the room air temperature Tr and the outside air temperature To is higher.

In step S240, the control device 30 sets the action mode of the air circulation switching device 20, on the basis of the result of the comparison between the room air temperature Tr and the outside air temperature To, and of the switching state of the four-way switching valve 15, such that the air at a relatively high temperature circulates through the heat exchanger acting as the evaporator at the time of start of the compressor 13. The action mode is determined using a switching table. After the action mode of the air circulation switching device 20 has been set according to the switching table, the air at a relatively high temperature is circulated through the heat exchanger acting as the evaporator over a predetermined period. Thereafter, the control device proceeds to the next step.

In step S250, after a lapse of a set time since the humidity adjustment device 1 has been started, the control device 30 determines whether or not the outside air temperature To is higher than the first set temperature TA. The set time is the time required for stabilizing the outside air temperature To. This determination serves as a basis for the control device 30 to determine the operation mode. If the outside air temperature To is higher than the first set temperature TA (step 250: YES), the control device 30 sets the operation mode to the dehumidifying operation (step S261). If the outside air temperature To is equal to or lower than the first set temperature TA (step 250: NO), the control device 30 proceeds to the next step 260.

In step S260, the control device 30 determines whether or not the outside air temperature To is equal to or higher than the second set temperature TB. When the outside air temperature To is equal to or higher than the second set temperature TB (step S260: YES), the control device 30 sets the operation mode to the ventilating operation (step S262). When the outside air temperature To is lower than the second set temperature TB (step S260: NO), the control device 30 sets the operation mode to the humidifying operation (step S263).

In step S270, the control device 30 switches the action mode of the air circulation switching device 20 on the basis of the switching state of the four-way switching valve 15 and the set operation mode. Then, the control device 30 opens the electronic expansion valve 14 to a predetermined opening degree, and gradually increases the frequency of the PWM signal by the inverter circuit to raise the frequency of the PWM signal to a predetermined frequency. In this way, the compressor 13 is started.

Next, the above switching table will be described with reference to FIG. 8.

The switching table is used for setting the action mode of the air circulation switching device 20 during the preparatory operation control. When the four-way switching valve 15 is in the first switching state, the second heat exchanger 12 acts as the evaporator. In this state, if the outside air temperature To is higher than the room air temperature Tr, the outside air OA is applied to the second heat exchanger 12. The action mode in which the outside air OA is applied to the second heat exchanger 12 corresponds to the first action mode. Thus, as shown in FIG. 8, the first action mode is assigned to the above condition. On the other hand, when the room air temperature Tr is equal to or higher than the outside air temperature To, the room air RA is applied to the second heat exchanger 12. The action mode in which the room air RA is applied to the second heat exchanger 12 corresponds to the second action mode. Thus, the second action mode is assigned to the above condition.

When the four-way switching valve 15 is in the second switching state, the first heat exchanger 11 acts as the evaporator. In this state, when the outside air temperature To is higher than the room air temperature Tr, the outside air OA is applied to the first heat exchanger 11. The action mode in which the outside air OA is applied to the first heat exchanger 11 corresponds to the second action mode. Thus, the second action mode is assigned to the above condition. On the other hand, when the room air temperature Tr is equal to or higher than the outside air temperature To, the room air RA is applied to the first heat exchanger 11. The action mode in which the room air RA is applied to the first heat exchanger 11 corresponds to the first action mode. Thus, the first action mode is assigned to the above condition.

Figure 9A:
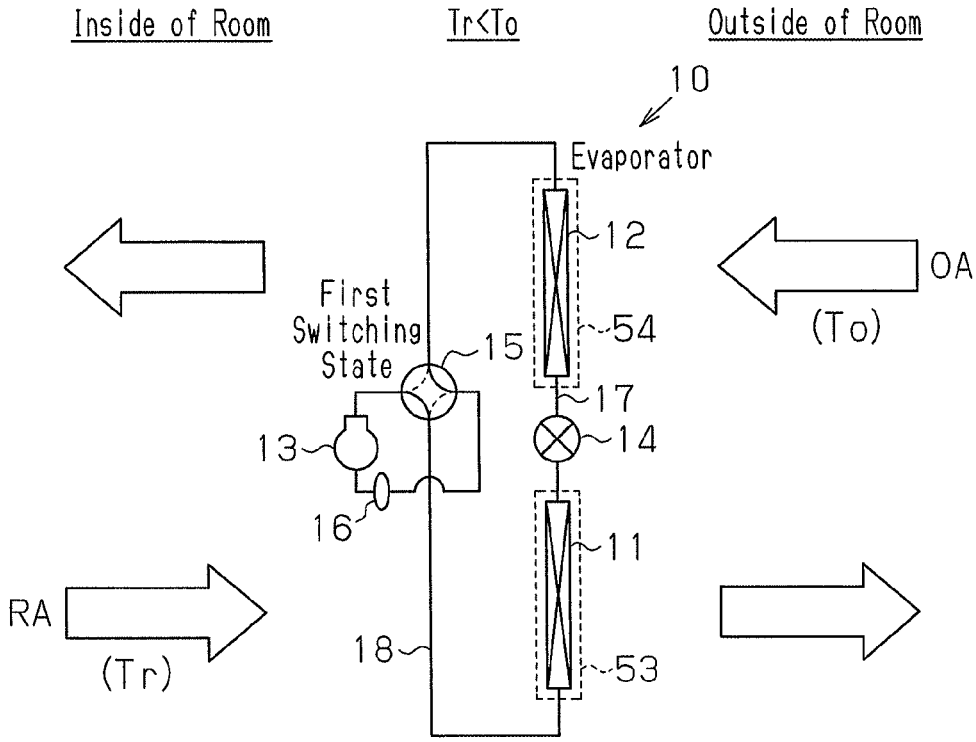
FIG. 9(*a*) is a diagram showing a state of a refrigerant circuit and an air flow when an outside air temperature is higher than a room air temperature.
Figure 9B:
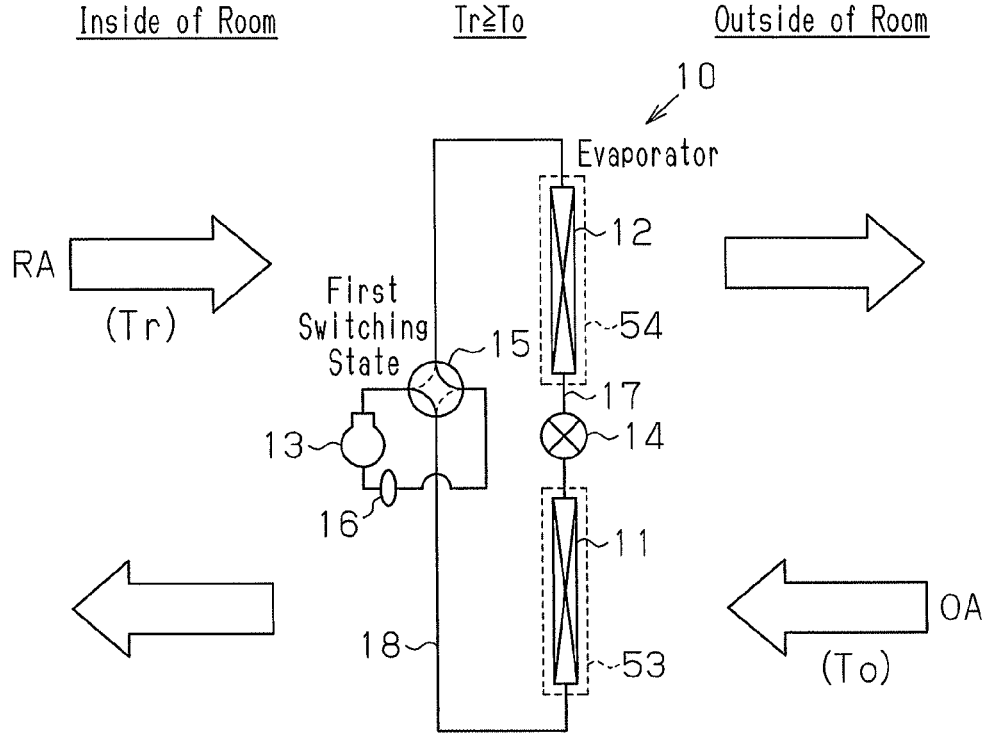

Next, the state of air circulation during the preparatory operation control will be described with reference to FIG. 9.

Figures 7, 8:
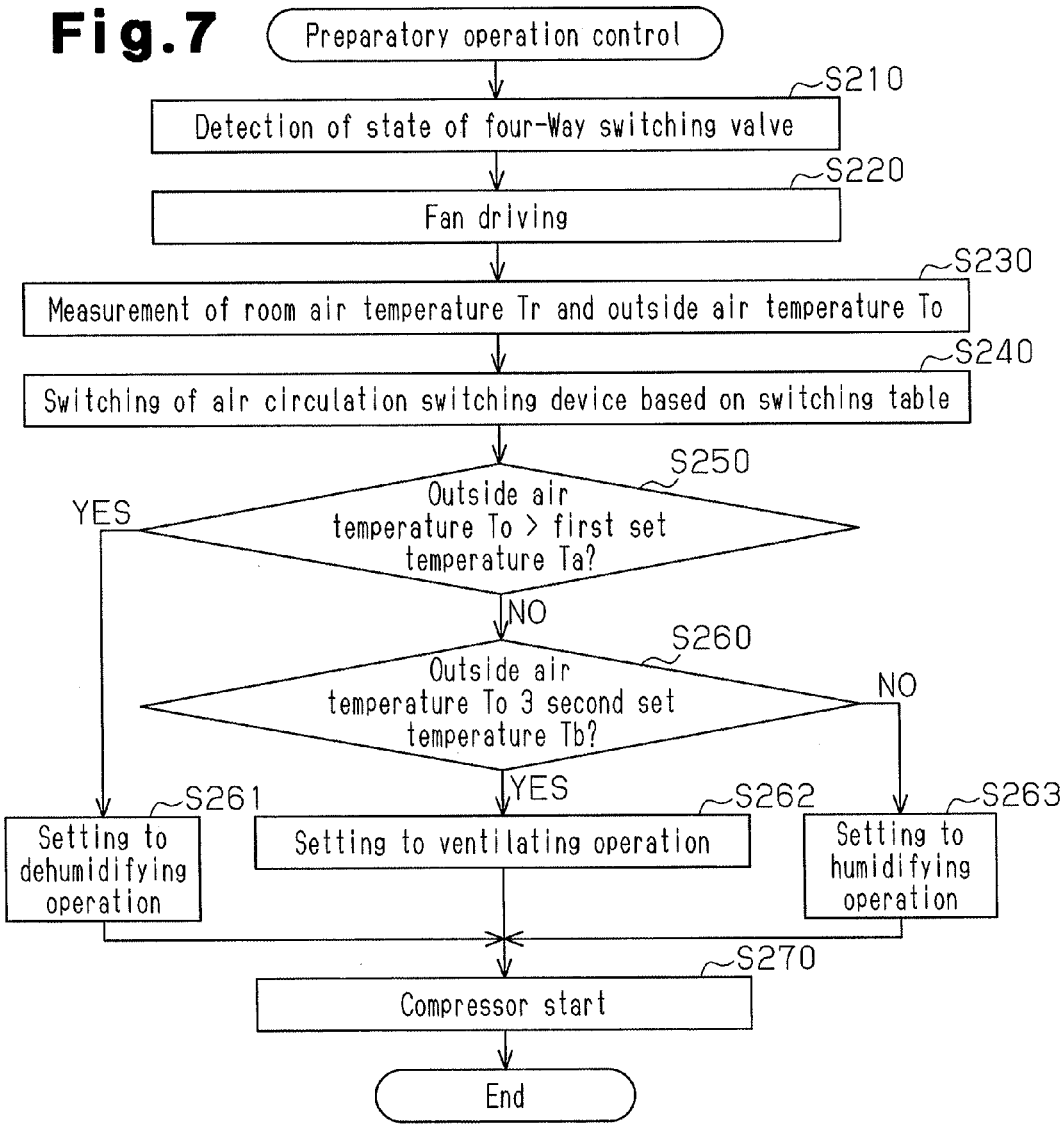
FIG. 7 is a flow chart showing a procedure of preparatory operation control.
FIG. 8 is a switching table used for setting the action mode of the air circulation switching device during the preparatory operation control.

As shown in No 1 of FIG. 8, in a case where the four-way switching valve 15 is set to the first switching state and the outside air temperature To is higher than the room air temperature Tr, according to the switching table, the air circulation switching device 20 is set to the first action mode. In this case, as shown in FIG. 9(*a*), the outside air OA is applied to the second heat exchanger 12. Thus, compared to a case where the room air RA at a relatively low temperature is applied to the second heat exchanger 12, cooling of the second heat exchanger 12 (evaporator) can be suppressed to a low level.

As shown in No 2 of FIG. 8, in a case where the four-way switching valve 15 is set to the first switching state and the outside air temperature To is equal to or lower than the room air temperature Tr, according to the switching table, the air circulation switching device 20 is set to the second action mode. In this case, as shown in FIG. 9(*b*), the room air RA is applied to the second heat exchanger 12. Thus, compared to a case where the outside air OA at a relatively low temperature is applied to the second heat exchanger 12, cooling of the second heat exchanger 12 (evaporator) can be suppressed to a low level.

The same holds true for the conditions corresponding to No 3 and No 4 of FIG. 8. In the case of No 3 of FIG. 8, the outside air OA is applied to the first heat exchanger 11. Thus, compared to the case where the room air RA at a relatively low temperature is applied to the first heat exchanger 11, cooling of the first heat exchanger (evaporator) can be suppressed to a low level. In the case of No 4 of FIG. 8, the room air RA is applied to the first heat exchanger 11. Thus, compared to the case where the outside air OA at a relatively low temperature is applied to the first heat exchanger 11, cooling of the first heat exchanger (evaporator) can be suppressed to a low level.

As explained above, during the preparatory operation control, the air at a relatively high temperature is circulated through the heat exchanger acting as the evaporator by the action of the air circulation switching device 20 based on the switching table. This allows the excessive cooling of the evaporator to be suppressed.

The following will explain the reason for selectively circulating the air at a relatively high temperature through the heat exchanger acting as the evaporator at the time of startup of the humidity adjustment device 1.

When the humidity adjustment device 1 is started up, the operation mode is determined on the basis of the outside air temperature To. In this case, in order to precisely measure the outside air temperature To, the supply fan 91 and the exhaust fan 92 are driven. This causes the outside air OA and the room air RA to enter the humidity adjustment device 1. When the temperatures of the outside air OA and the room air RA are high, there is little increase in the liquid refrigerant. On the other hand, when the temperature of the outside air OA or the room air RA is low, especially when lower than the condensing temperature of the refrigerant, the amount of the liquid refrigerant increases, as the refrigerant inside the first heat exchanger 11 or the second heat exchanger 12 is liquefied. Thus, when the amount of the liquid refrigerant inside the heat exchanger acting as the evaporator becomes large, the refrigerant can flow into the compressor 13 through the accumulator 16 at the time of start of the compressor 13. Once the liquid refrigerant enters the compressor 13, the refrigerant evaporates after the lubricating oil and the liquid refrigerant mix with each other, which can lead to an outflow of the lubricating oil to the refrigerant circuit 10.

For this reason, according to the present invention, the air at a relatively high temperature is selectively circulated through the heat exchanger acting as the evaporator at the time of startup of the humidity adjustment device 1. In this way, the increase of the liquid refrigerant inside the evaporator can be suppressed.

However, the preparatory operation control may be changed as follows.

In the above embodiment, at the time of startup of the humidity adjustment device 1, regardless of the season, the control (startup air circulation control) of circulating the air at a relatively high temperature through the heat exchanger acting as the evaporator is executed. However, it is a rare case that the refrigerant inside the evaporator is liquefied in a large amount. In other words, it is unusual that the air at a temperature as low as near the condensing temperature of the refrigerant is introduced into the evaporator. In this case, since the amount of liquefaction of the refrigerant is small, the liquid refrigerant rarely flows into the compressor 13 through the accumulator 16. Therefore, the above startup air circulation control may be executed in the following manner.

The highest temperature at which there is a possibility of return of the liquid refrigerant to the compressor 13 is set as a set temperature TC. The set temperature TC is, for example, set to the room temperature (25° C.). When the set temperature C is higher than the room temperature, there is little reliquefaction of the evaporated refrigerant. On this basis, the set temperature TC is set to the room temperature (25° C.). In this case, at the time of startup of the humidity adjustment device 1, if the temperature of the outside air OA and the temperature of the room air RA are both higher than the set temperature TC, the startup air circulation control is not executed. This allows the air, also at the time of startup of the humidity adjustment device 1, to be introduced into the heat exchanger in the same pattern as in the operation mode after the preparatory operation control.

Thus, according to the present embodiment, the following effects can be obtained.

(1) At the time of startup of the humidity adjustment device 1, the control device 30 compares the outside air temperature To and the room air temperature Tr to determine which of the air temperatures is higher, and circulates one of the outside air OA and the room air RA which is at a higher temperature through the evaporator. Thus, the excessive liquefaction of the refrigerant inside the evaporator resulting from excessive cooling of the evaporator can be suppressed. Accordingly, the return of the liquid refrigerant to the compressor 13 is suppressed.

(2) When the humidity adjustment device 1 is shut down in the humidifying operation period and in the dehumidifying operation period, the first refrigerant passage 17 where the electronic expansion valve 14 is provided is put into a communicating state. This allows the refrigerant inside the first refrigerant passage 17 to be moved during the shutdown period of the humidity adjustment device 1. Thus, as the amount of the refrigerant flowing into the compressor 13 decreases, the reduction of the lubricating oil in the compressor 13 can be suppressed.

(3) The control device 30 compares the outside air temperature To and the room air temperature Tr, on the basis of a difference occurring between the temperature detected by the first temperature sensor 31 and the temperature detected by the second temperature sensor 32, to determine which of the air temperatures is higher. Thus, compared to the case where the both temperatures are compared when the values of the temperature detected by the first temperature sensor 31 and the temperature detected by the second temperature 32 have been stabilized, the time taken for determining which of the outside air OA and the room air RA is at a higher temperature can be reduced.

(4) In the above modified example, if the temperature of the outside air OA and the temperature of the room air RA are both higher than the set temperature TC at the time of startup of the humidity adjustment device 1, the process, in which one of the outside air OA and the room air RA which is at a higher temperature is circulated through the evaporator, is not executed. This way of processing allows the air to be introduced into the heat exchanger in the same pattern as in the operation mode after the preparatory operation control.

However, the present embodiment may be changed as follows.

In the present embodiment, when the humidity adjustment device 1 is shut down in the humidifying operation period and in the dehumidifying operation period, the first refrigerant passage 17 where the electronic expansion valve 14 is provided is put in a communicating state. As a requirement for this, a condition under which the amount of the refrigerant flowing into the compressor 13 becomes excessive may be added. The factor that causes the amount of the refrigerant flowing into the compressor 13 to become excessive is that a difference between the refrigerant pressure in the refrigerant passage including the first heat exchanger 11 and the refrigerant pressure in the refrigerant passage including the second heat exchanger 12 becomes too large. Specifically, during shutdown of the humidity adjustment device 1 in the humidifying operation period and the dehumidifying operation period, first, the refrigerant pressure in the refrigerant passage including the first heat exchanger 11 and the refrigerant pressure in the refrigerant passage including the second heat exchanger 12 are compared. Then, when the difference becomes larger than a threshold value, the opening degree of the electronic expansion valve 14 is set to the stopping opening degree to put the refrigerant passage where the electronic expansion valve 14 is provided into the communicating state. The refrigerant pressure is detected by a steam pressure sensor.

In the present embodiment, at the time of startup of the humidity adjustment device 1, the control (startup air circulation control) of selectively circulating the air at a relatively high temperature through the heat exchanger acting as the evaporator is executed. During this time, the four-way switching valve 15 is maintained in the switching state for the shutdown control. However, after the preparatory operation control, the inflow of the refrigerant to the compressor 13 can be suppressed also by controlling the switching of the four-way switching valve 15. Specifically, first, in a stopped state of the compressor 13 during the preparatory operation control, the supply fan 91 and the exhaust fan 92 are activated to force the room air RA and the outside air OA into the humidity adjustment device 1. Next, the outside air temperature To and the room air temperature Tr are measured, and the outside air temperature To and the room air temperature Tr are compared to determine which of the air temperatures is higher. Then, at the time of startup of the compressor 13, the four-way switching valve 15 is switched such that, of the first heat exchanger 11 and the second heat exchanger 12, the heat exchanger through which the air at a higher temperature is circulating acts as the evaporator. This allows the liquid refrigerant to be present in the condenser, even when either of the outside air OA and the room air RA is at a temperature low enough to liquefy the refrigerant. Thus, the inflow of the liquid refrigerant to the compressor 13 at the time of startup of the compressor 13 can be suppressed.

In the present embodiment, at the time of startup of the humidity adjustment device 1, the control (startup air circulation control) of selectively circulating the air at a relatively high temperature through the heat exchanger acting as the evaporator is executed. However, the excessive cooling of the heat exchanger acting as the evaporator can be suppressed also by providing the humidity adjustment device 1 with a bypass which changes the flows of the outside air OA and the room air RA. For example, a first bypass connecting the first front compartment 51 and the second rear compartment 56 is provided. Then, a fifth opening-closing mechanism which opens and closes the air passage is provided in the middle of the first bypass. Further, a second bypass connecting the second front compartment 52 and the first rear compartment 55 is provided. Then, a sixth opening-closing mechanism which opens and closes the air passage is provided in the middle of the second bypass. At the time of startup of the humidity adjustment device 1, all of the first front opening-closing mechanism 71, the second front opening-closing mechanism 72, the third front opening-closing mechanism 73, and the fourth front opening-closing mechanism 74 are put into the closed state, while the fifth opening-closing mechanism and the sixth opening-closing mechanism are put into the opened state. This configuration can prevent the outside air OA and the room air RA from circulating through the first heat exchanger 11 and the second heat exchanger 12. Thus, since the heat exchanger acting as the evaporator is not excessively cooled, the return of the liquid refrigerant to the compressor at the time of startup of the compressor 13 can be suppressed.

In the present embodiment, the first heat exchanger 11, the second heat exchanger 12, and the air circulation switching device 20 are housed in the one casing 40. However, these components may be provided separately from each other. This allows various aspects of the humidity adjustment device 1 in terms of arrangement.

In the present embodiment, the air circulation switching device 20 which switches the two air flows by the damper control is adopted. However, the room air switching device 21 may be configured as follows. That is, a main passage for introducing the room air RA may be branched into a first passage leading to the first heat exchanger compartment 53 and a second passage leading to the second heat exchanger compartment 54, and a valve may be provided at the branching portion such that, by the action of the valve, either of the first passage and the second passage communicates with the main passage.

In the present embodiment, the room suction port 57 through which the room air RA flows in and the outside suction port 58 through which the outside air OA flows in are provided in the front wall 41. However, the arrangement of the room suction port 57 and the outside suction port 58 is not limited to this. Similarly, the arrangement of the supply port 59 and the exhaust port 60 is not limited.

In the present embodiment, in the period of the preparatory operation control, the control (startup air circulation control) of selectively circulating the air at a relatively high temperature through the heat exchanger acting as the evaporator is executed. However, the period of the startup air circulation control may be appropriately changed. For example, the startup air circulation control may be extended such that the startup air circulation control continues until the rotation speed of the electric motor of the compressor 13 reaches a predetermined rotation speed.

The invention claimed is:

1. A humidity adjustment device, including:

a refrigerant circuit which includes a compressor, a first heat exchanger carrying an adsorbent, a second heat exchanger carrying an adsorbent, an electronic expansion valve, and a four-way switching valve;

an air circulation switching device that switches air to be circulated through the first heat exchanger and air to be circulated through the second heat exchanger; and a control device controlling operations of the compressor, the electronic expansion valve, the four-way switching valve and the air circulation switching device, wherein the control device controls the operation of the four-way switching valve such that one of the first heat exchanger and the second heat exchanger is defined as a condenser to function as a humidifier by a regeneration action of the adsorbent, while the other heat exchanger is defined as an evaporator to function as a dehumidifier by an adsorption action of the adsorbent, and the functions of both the heat exchangers are switched by changing a refrigerant flow inside the refrigerant circuit, wherein the control device compares an outside air temperature and a room air temperature to determine which of the air temperatures is higher, and at the time of startup of the humidity adjustment device, the control device controls the operation of the air circulation switching device such that one of the outside air and the room air which is at a higher temperature is circulated through the heat exchanger acting as the evaporator, of the first heat exchanger and the second heat exchanger, while the air at a lower temperature is circulated through the heat exchanger acting as the condenser, of the first heat exchanger and the second heat exchanger.

2. The humidity adjustment device according to claim 1, wherein when the humidity adjustment device is shut down, at least in a humidification operation period and in a dehumidification operation period, a refrigerant passage where the electronic expansion valve is provided is put into a communicating state.

3. The humidity adjustment device according to claim 2, wherein, the humidity adjustment device is provided inside with: a first temperature sensor which detects the room air temperature; a second temperature sensor which detects the outside air temperature; an exhaust fan which forces the room air into the humidity adjustment device and exhausts the room air to the outside of the room; and a supply fan which forces the outside air into the humidity adjustment device and supplies the outside air to the inside of the room, at the time of startup of the humidity adjustment device and before the start of the compressor, the exhaust fan is driven to force the room air in, while the supply fan is driven to force the outside air in, and on the basis of a difference occurring between a temperature detected by the first temperature sensor and a temperature detected by the second temperature sensor, the outside air temperature and the room air temperature are compared to determine which of the air temperatures is higher.

4. The humidity adjustment device according to claim 3, wherein at the time of startup of the humidity adjustment device, if the outside air temperature and the room air temperature are both higher than a set temperature, the process, in which one of the outside air and the room air which is at a higher temperature is circulated through the heat exchanger functioning as the evaporator, is not executed.

5. The humidity adjustment device according to claim 2, wherein at the time of startup of the humidity adjustment device, if the outside air temperature and the room air temperature are both higher than a set temperature, the process, in which one of the outside air and the room air which is at a higher temperature is circulated through the heat exchanger functioning as the evaporator, is not executed.

6. The humidity adjustment device according to claim 1, wherein, the humidity adjustment device is provided inside with: a first temperature sensor which detects the room air temperature; a second temperature sensor which detects the outside air temperature; an exhaust fan which forces the room air into the humidity adjustment device and exhausts the room air to the outside of the room; and a supply fan which forces the outside air into the humidity adjustment device and supplies the outside air to the inside of the room, at the time of startup of the humidity adjustment device and before the start of the compressor, the exhaust fan is driven to force the room air in, while the supply fan is driven to force the outside air in, and on the basis of a difference occurring between a temperature detected by the first temperature sensor and a temperature detected by the second temperature sensor, the outside air temperature and the room air temperature are compared to determine which of the air temperatures is higher.

7. The humidity adjustment device according to claim 6, wherein at the time of startup of the humidity adjustment device, if the outside air temperature and the room air temperature are both higher than a set temperature, the process, in which one of the outside air and the room air which is at a higher temperature is circulated through the heat exchanger functioning as the evaporator, is not executed.

8. The humidity adjustment device according to claim 1, wherein at the time of startup of the humidity adjustment device, if the outside air temperature and the room air temperature are both higher than a set temperature, the process, in which one of the outside air and the room air which is at a higher temperature is circulated through the heat exchanger functioning as the evaporator, is not executed.

9. A humidity adjustment device, including:

a refrigerant circuit which includes a compressor, a first heat exchanger carrying an adsorbent, a second heat exchanger carrying an adsorbent, an electronic expansion valve, and a four-way switching valve;

an air circulation switching device which switches air to be circulated through the first heat exchanger and air to be circulated through the second heat exchanger; and a control device controlling operations of the compressor, the electronic expansion valve, the four-way switching valve and the air circulation switching device, wherein the control device controls the operation of the four-way switching valve such that one of the first heat exchanger and the second heat exchanger is defined as a condenser to function as a humidifier by a regeneration action of the adsorbent, while the other heat exchanger is defined as an evaporator to function as a dehumidifier by an adsorption action of the adsorbent, and the functions of both the heat exchangers are switched by changing a refrigerant flow inside the refrigerant circuit, wherein at the time of startup of the humidity adjustment device, the control device controls the operation of the air circulation switching device such that the outside air is forced into one of the evaporator and the condenser while the room air is forced into the other, and the control device compares the outside air temperature and the room air temperature to determine which of the air temperatures is higher, and at the time of start of the compressor, the control device controls the operation of the four-way switching valve such that of the first heat exchanger and the second heat exchanger, the heat exchanger through which the air at a higher temperature is circulating functions as the evaporator.

* * * * *